US011559118B2

(12) United States Patent
Diercks et al.

(10) Patent No.: US 11,559,118 B2
(45) Date of Patent: Jan. 24, 2023

(54) WEARABLE SOUVENIR HOLDER WITH BREAKAWAY FUNCTIONALITY

(71) Applicants: Tiffany Ann Diercks, Elizabethtown, KY (US); Brooks Lee Collins, Elizabethtown, KY (US)

(72) Inventors: Tiffany Ann Diercks, Elizabethtown, KY (US); Brooks Lee Collins, Elizabethtown, KY (US)

( * ) Notice: Subject to any disclaimer, the term of this patent is extended or adjusted under 35 U.S.C. 154(b) by 100 days.

(21) Appl. No.: 17/248,973

(22) Filed: Feb. 16, 2021

(65) Prior Publication Data

US 2021/0251350 A1 Aug. 19, 2021

Related U.S. Application Data

(60) Provisional application No. 62/976,759, filed on Feb. 14, 2020.

(51) Int. Cl.
*A44C 5/20* (2006.01)
*A44C 5/00* (2006.01)

(52) U.S. Cl.
CPC ..... *A44C 5/003* (2013.01); *A44C 5/2071* (2013.01)

(58) Field of Classification Search
CPC ..... A44C 5/003; A44C 5/2071; A44C 25/001; A44C 25/002; A44C 5/0007; A44C 5/0053; A44C 3/00
USPC ..... 224/219, 221, 267
See application file for complete search history.

(56) References Cited

U.S. PATENT DOCUMENTS

| | | | | |
|---|---|---|---|---|
| 1,080,240 | A * | 12/1913 | Tidd | A45F 5/00 453/54 |
| 1,163,173 | A | 12/1915 | Pusinelli | |
| 1,325,607 | A | 12/1919 | Barber | |
| 2,521,006 | A | 9/1950 | Hamilton | |
| 3,996,766 | A | 12/1976 | Welch | |
| 4,165,573 | A | 8/1979 | Richards | |
| 4,854,133 | A | 8/1989 | Irwin | |
| 4,970,878 | A | 11/1990 | Lee | |
| 5,052,195 | A | 10/1991 | Lunt | |
| 5,219,069 | A | 6/1993 | Sonnek | |
| 7,988,349 | B2 | 8/2011 | Anderson | |
| 8,408,387 | B2 | 4/2013 | Sottile | |
| 8,474,284 | B2 | 7/2013 | Rush et al. | |
| D711,762 | S | 8/2014 | Murphy | |
| 9,293,068 | B1 | 3/2016 | Hibbert | |
| 9,439,480 | B1 | 9/2016 | French | |
| 11,185,135 | B2 * | 11/2021 | Zanghi | A44C 27/008 |
| 2002/0162355 | A1 | 11/2002 | Andersen | |
| 2008/0178977 | A1 | 7/2008 | Nauman | |
| 2009/0265971 | A1 * | 10/2009 | Cook | G09F 3/005 224/267 |
| 2012/0234043 | A1 * | 9/2012 | Guerrero, II | A44C 5/0007 63/3.1 |

(Continued)

*Primary Examiner* — Jack W Lavinder
(74) *Attorney, Agent, or Firm* — Dunlap Bennett & Ludwig, PLLC

(57) ABSTRACT

A souvenir holder that is wearable through one or more band portions configured to form a loop. The one or more band portions provide penetration holes operatively associable with a breakaway closure system configured to move the loop between a locked engagement and an unlocked engagement. The unlocked engagement is defined by at least two modes, including a breakaway mode wherein the breakaway closure system breaks when one or more of the band portions are caught on an object while worn.

9 Claims, 5 Drawing Sheets

(56) References Cited

U.S. PATENT DOCUMENTS

| | | | | |
|---|---|---|---|---|
| 2014/0090418 | A1* | 4/2014 | Mihalyo | A44C 5/0084 63/3 |
| 2018/0210400 | A1* | 7/2018 | Kaneko | A44C 5/2071 |

* cited by examiner

WEARABLE SOUVENIR HOLDER WITH BREAKAWAY FUNCTIONALITY

CROSS-REFERENCE TO RELATED APPLICATION

This application claims the benefit of priority of U.S. provisional application No. 62/976,759 filed 14 Feb. 2020, the contents of which are herein incorporated by reference.

BACKGROUND OF THE INVENTION

The present invention relates to souvenir accessories and, more particularly, a wearable souvenir holder by way of an adjustable band with a breakaway safety feature.

Souvenir coin machines are a staple at museums, theme parks, and other memorable exhibitions. The resulting elongated souvenir coin serves as a token of the memories forged at such events. And individuals enjoy collecting the souvenir coins but have no way of securely displaying them in everyday use or on their person. Current devices used to secure souvenir elongated coins are one size only and do not take wearers' safety into consideration; for example, a child can get the bands of these devices caught on objects, resulting in injury. Moreover, the one-size only bands do not fit small children hands or large adults adequately or appropriately, which furthers the safety hazard. Furthermore, the material used on other bands are thin and do not last long; rather, they stretch out and do not hold the souvenir item after extended use. In short, there is currently no souvenir coin holder that has a band with a safety breakaway feature or that is adjustable to accommodate the growth of the wearer.

As can be seen, there is a need for wearable souvenir holder by way of an adjustable band with a breakaway safety feature. The present invention embodies such a souvenir holder with lipped edges to secure an elongated coin or other souvenir, and the souvenir holder is wearable through a band that is adjustable to fit any individual's size and provides a break-away safety feature. The breakaway safety feature may include a double click closure to ensure a secure connection between the band and the wearer, while also enabling the closure to unlock or 'break away' if the band is caught on an object. As compared to the prior art, the band is made of a thicker material which is more durable, longer lasting and secures the souvenir item for the life of the wearer and possibly beyond.

As a result, the present invention allows any individual to wear their elongated souvenir coins (and change them as often as they like) while being adjustable to fit that individual to their liking with a safety break away feature in case where the band is caught on anything. Finally, the adjustability of the band enables the present invention to "grow" with the wearer so they can wear their souvenir elongated coin for a lifetime and/or pass it down to future generations.

SUMMARY OF THE INVENTION

In one aspect of the present invention, a wearable souvenir holder includes the following: a souvenir holder having an opening configured to secure a souvenir; one or more band portions connected to the souvenir holder; a plurality of penetration points in each band portion; and a breakaway closure configured to move each band portion between a locked engagement and at least two unlocked engagements, wherein one of the two unlocked engagements includes a failing of the breakaway closure.

In another aspect of the present invention, the wearable souvenir holder further includes the one or more band portions being configured to form a loop, wherein the breakaway closure comprises at least one prong configured to slide through two penetration points of the plurality of penetration points that align during the formed loop, wherein each prong is configured to ultimately fail under a predetermined force urged by the one or more band portions, whereby said failing is effectuated, wherein said opening is defined by a deformable lipped edge, wherein the souvenir holder is removably attached to the one or more band portions; and a nodule on the one or more band portions; and comprising a nodule bracket provided along an underside of the souvenir holder for removably connecting to said nodule, wherein the souvenir is an elongated souvenir coin, and wherein said opening is oval.

In yet another aspect of the present invention, a method of wearing an elongated souvenir coin, the method includes the following: providing the above mentioned wearable souvenir holder; forming the loop around a body portion of a wearer by way of the one or more band portions; and moving each band portion to the locked engagement by way of the breakaway closure.

These and other features, aspects and advantages of the present invention will become better understood with reference to the following drawings, description and claims.

DETAILED DESCRIPTION OF THE INVENTION

Figure 1:
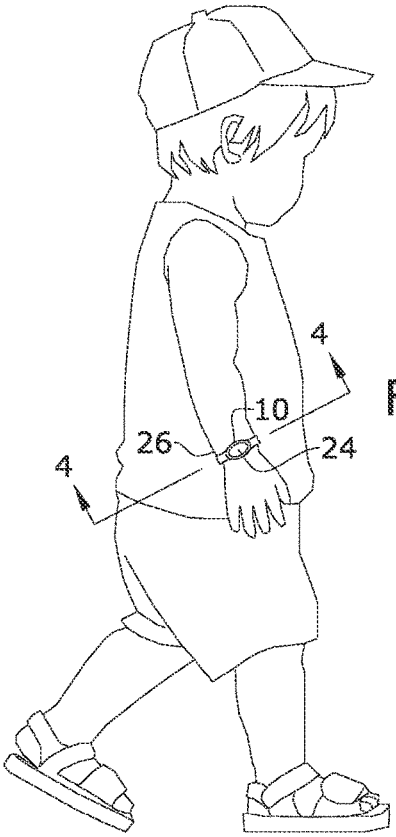
FIG. 1 is a perspective view of an exemplary embodiment of the present invention, shown in use.
Figure 2:
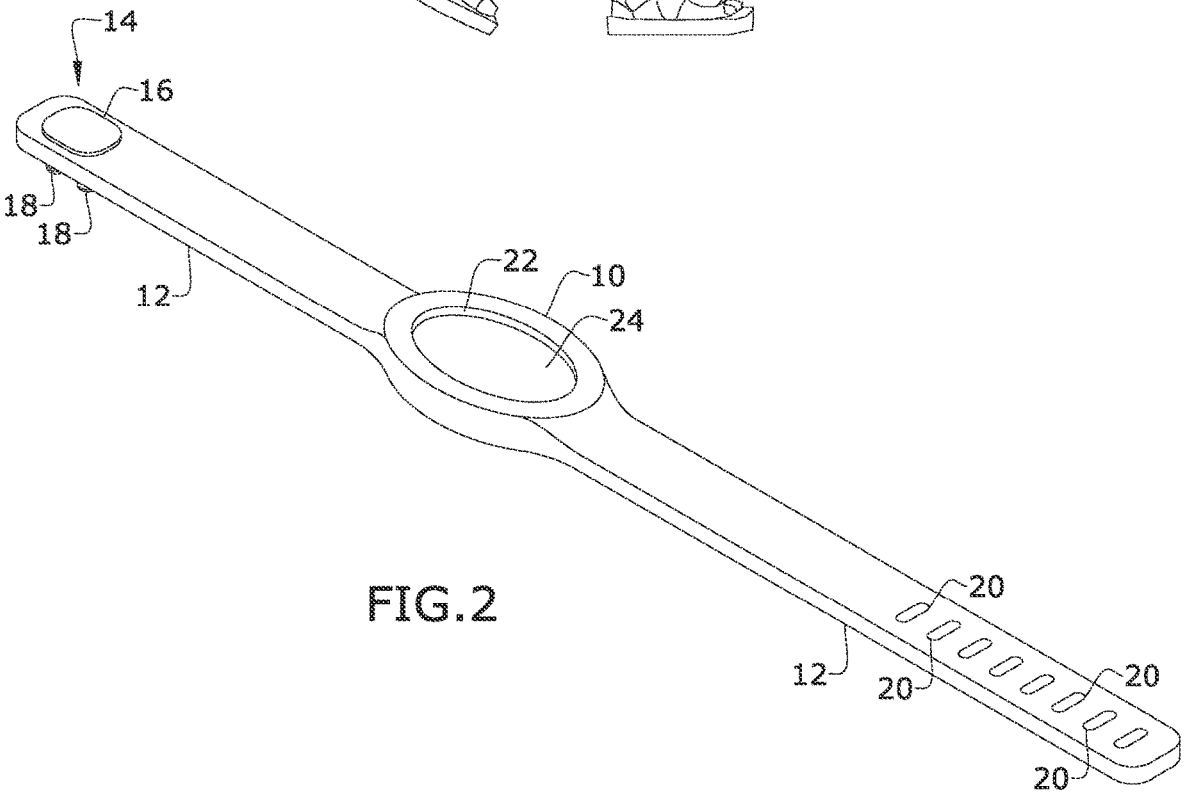
FIG. 2 is a perspective view of an exemplary embodiment of the present invention.
Figure 3:
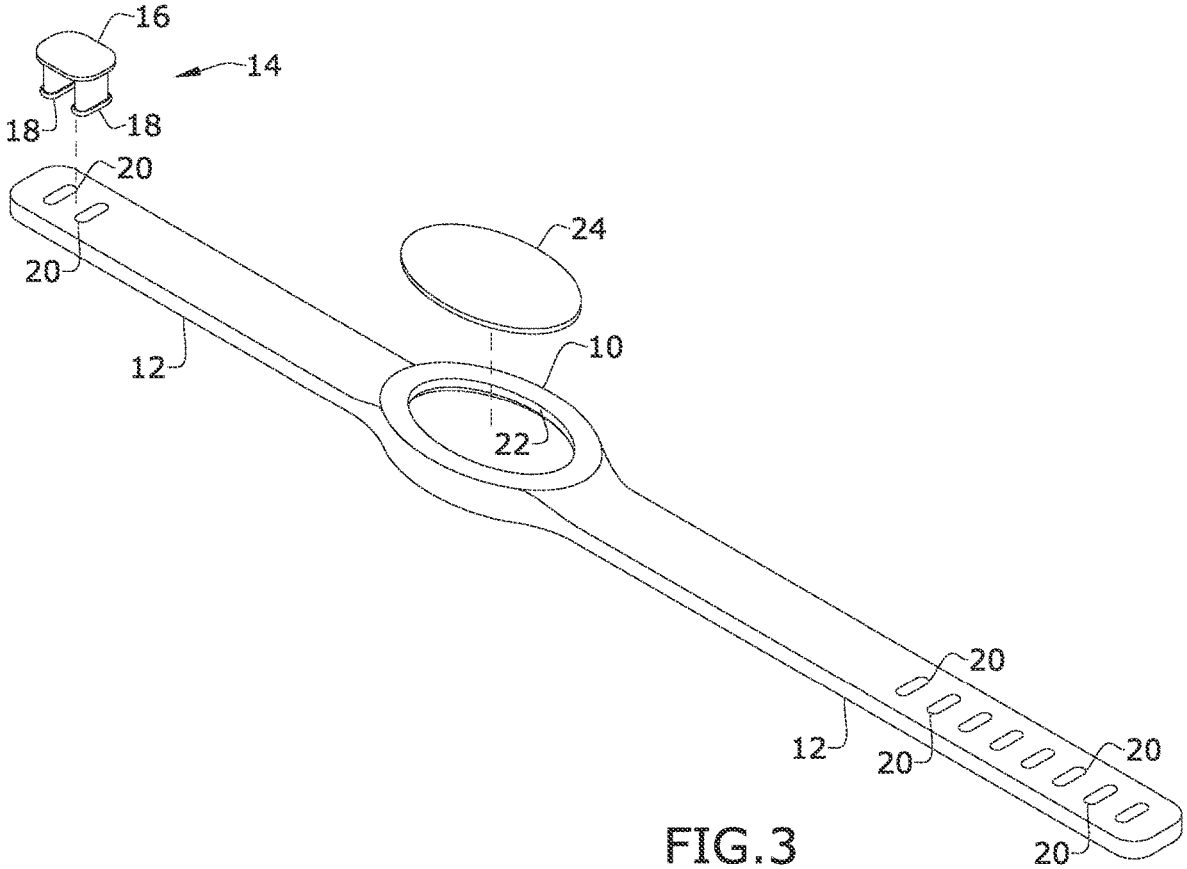
FIG. 3 is an exploded perspective view of an exemplary embodiment of the present invention.
Figure 4:
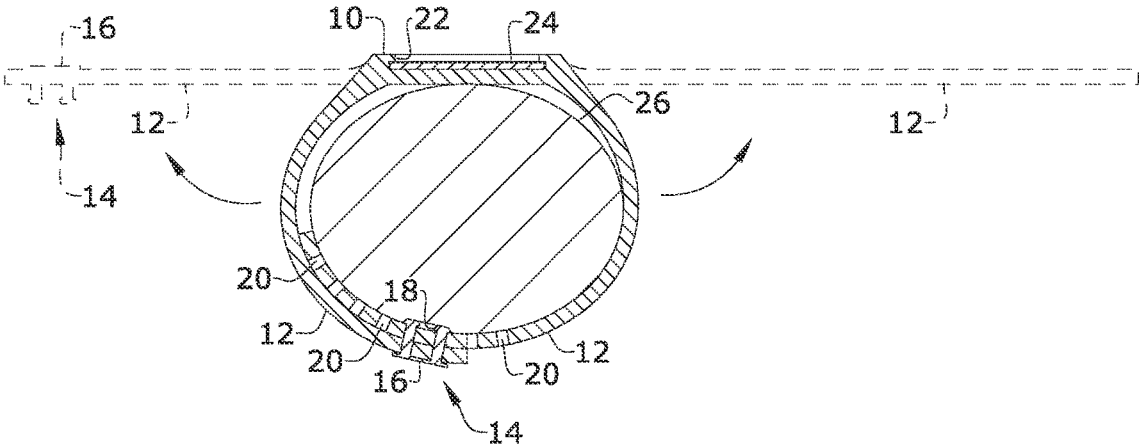
FIG. 4 is a section view of an exemplary embodiment of the present invention, taken along line 4-4 in FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a souvenir holder that is wearable through one or more band portions configured to form a loop. The one or more band portions provide penetration holes operatively associable with a breakaway closure system configured to move the loop between a locked engagement and an unlocked engagement. The unlocked engagement is defined by at least two modes, including a breakaway mode wherein the breakaway closure system breaks when one or more of the band portions are caught on an object while worn.

Referring now to FIGS. 1 through 11, the present invention may include a souvenir holder 10 providing an adjustable band 12 to be wearable. The souvenir holder 10 has one or more adjustable band portions 12, which are configured to form a loop for wrapping about a portion of the wearer (e.g., the wrist, the ankle or any other body part) or engage other objects, such as key chains or the like. The loop can be secured by a breakaway closure system that operatively associates with the one or more band portions 12 in a locked engagement, though the breakaway closure system is configured to unlock under predetermined urging of force.

The souvenir holder 10 defines an opening with an elastic lipped edge 22 that allows a user to stretch and deform the lipped edge 22 and slide the souvenir 24 into the opening so that the lipped edge 22, when returning to its biased, unstretched condition holds a periphery of the souvenir 24 securely in the lipped edge 22. The souvenir holder 10 may be attached to the one or more band portions 12, making the souvenir holder 10 wearable. In certain embodiments, the souvenir holder 10 may be joined to two opposing adjustable band portions 12, enabling an adjustable, comfortable fit to one of many possible body parts of the wearer.

In certain embodiments, the breakaway closure system includes a double closure clasp 14 having a base 16 with two spaced apart prongs extending therefrom, wherein each prong has a flange 18. These two prongs may be accommodated in the one or more band portions 12 by a pair of penetration points 20, such as but not limited to prong slits. The two prongs of the double closure clasp 14 operatively associates with two segments of the one or more band portions 12 that form the above-mentioned loop. The two segments of the one or more band portions 12 overlap and their respective pairs of penetration points 20 align, allowing the prongs to penetrate through both of said two segments by way of the pairs of penetration points 20, forming a locked engagement. The penetration points 20 may be deformable to enable said locked engagement. In the locked engagement, the cross-section of the prongs interfaces/engages the said two segments defining the undeformed penetration point 20, which have a periphery less than the flanges 18, and so the latter catches on the former.

The breakaway closure system is movable between the locked engagement and an unlocked engagement through different modes. In a first mode, unlocked engagement is facilitated by reversing the above-mentioned locked engagement—stretching the penetration points 20 sufficiently to enable the flanges 18 to pass therethrough. The other mode of moving to the unlocked engagement is the "breakaway feature".

In the "breakaway" mode the prongs, under a predetermined amount of force, snap, allowing the two segments to move relative to each other, unlocked. The force may be shear stress experienced between the two segments of band portions 12, when one or both of the two segments of the band portions 12 are caught on something. In certain embodiments, the prongs have an ultimate shear strength adapted so that a predetermined shear load urged by one of the band portions 12 produces a sliding ultimate failure on the material of the prong along a plane that is parallel to the direction of the force (parallel to the direction of the caught/snared band portion 12 at the interface with the prongs). The ultimate shear strength of the two prongs together, and theft force-resisting area, fail under the predetermined ultimate force (F). For instance, the cross-section of the prong loaded by F (e.g., hi shear) through a caught band portion 12, snap, freeing the wearer relative to the object the band portion is caught on. F is determined to be insufficient to break a small child's wrist 26, hand or arm bones.

The present invention can be made using several material types such as thread, fabric, silicone, plastic and metal. The souvenir holder 10 can be configured in a variety of ways to accommodate the medium used. In certain embodiments, if using a hard finish item such as plastic or metal the souvenir holder 10 may be converted to a locket style breakaway closure system apparatus where the lipped edge would click open and closed to change the souvenir 24. If a soft medium is used, then the material can be manipulated to place and change the souvenir 24. The adjustable band portions 12 can be changed to accommodate the various mediums as well. The penetration points 20 can be various sizes or shapes.

The souvenir holder 10 can be used as one piece or be created from multiple pieces in a locket style breakaway closure system. The adjustable band 12 can be changed into many different forms with different styles and shapes of penetration points 20. It can be more rounded or rectangular. The double closure clasp 14 can be changed to be one piece with the adjustable wrist band. It can be an individual piece that snaps into the ends with both pieces holding them together. It can also be converted into a watch like form with a single slide through penetration point.

Figure 5:
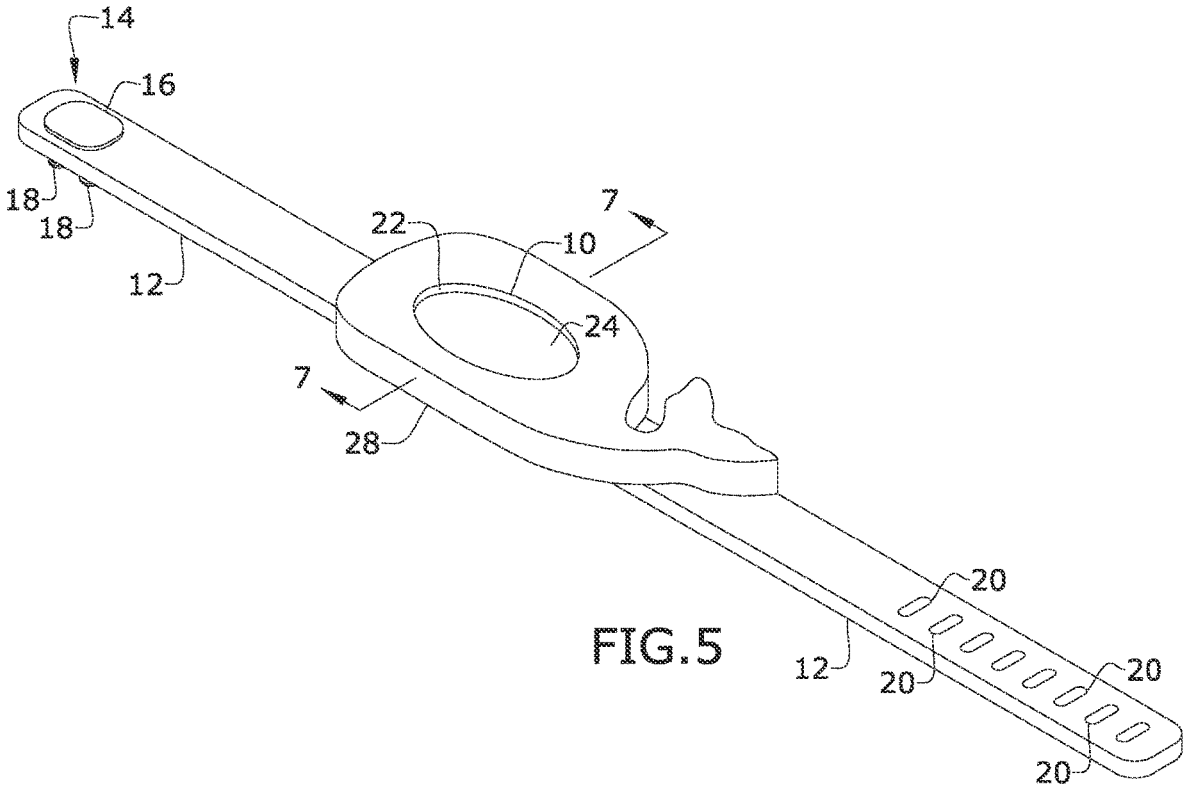
FIG. 5 is a perspective view of an exemplary embodiment of the present invention.
Figure 6:
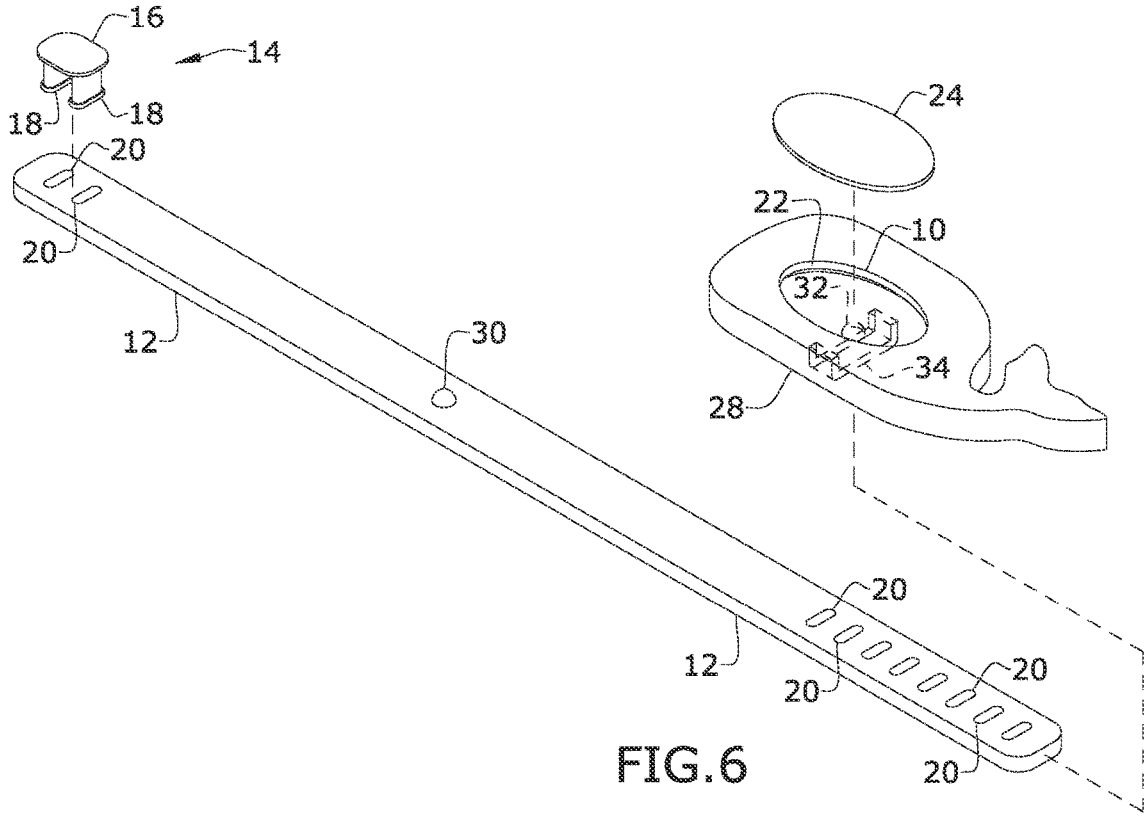
FIG. 6 is an exploded perspective view of an exemplary embodiment of the present invention.
Figure 7:
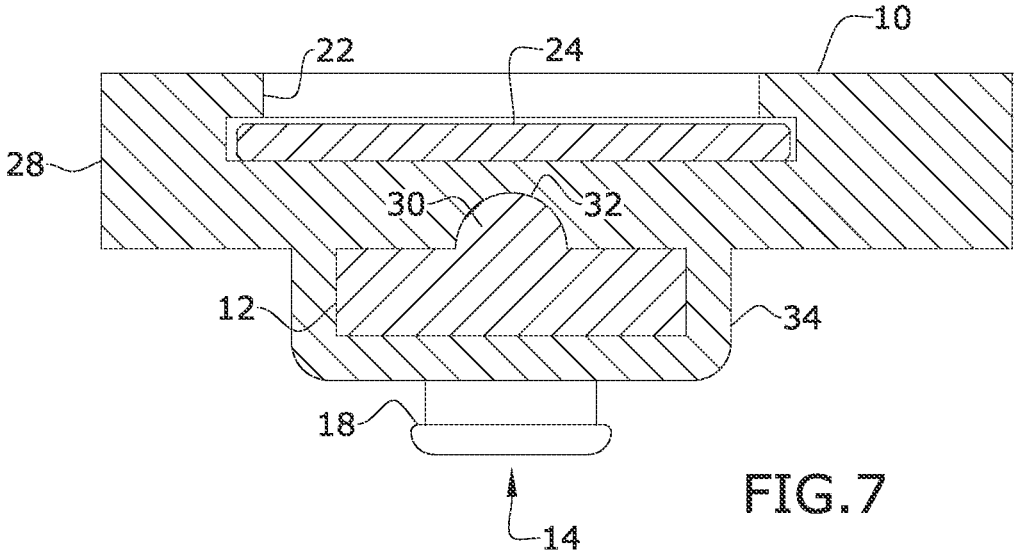
FIG. 7 is a section view of an exemplary embodiment of the present invention, taken along line 7-7 in FIG. 5.
Figure 8:
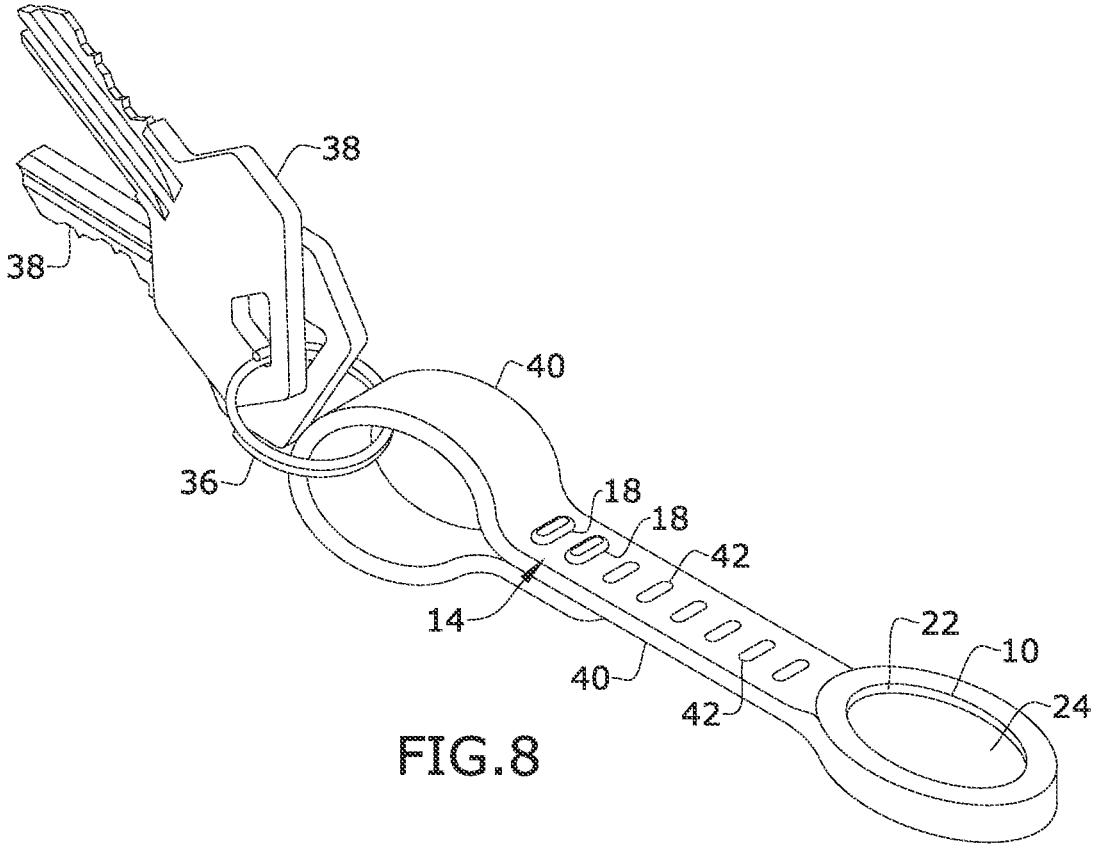
FIG. 8 is a perspective view of an exemplary embodiment of the present invention.
Figure 9:
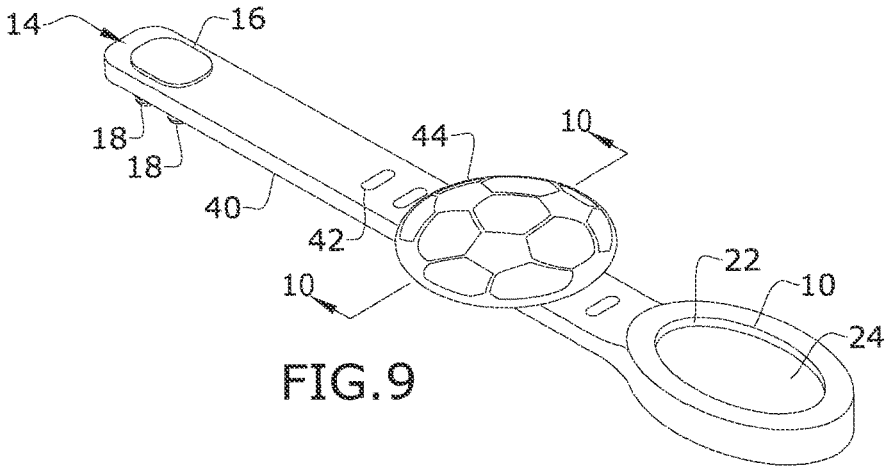
FIG. 9 is an exploded perspective view of an exemplary embodiment of the present invention.
Figure 10:
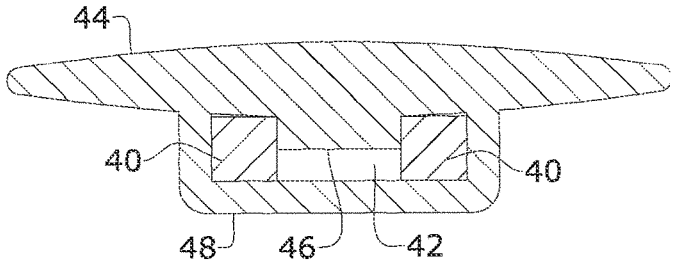
FIG. 10 is a section view of an exemplary embodiment of the present invention, taken along line 10-10 in FIG. 9.
Figure 11:
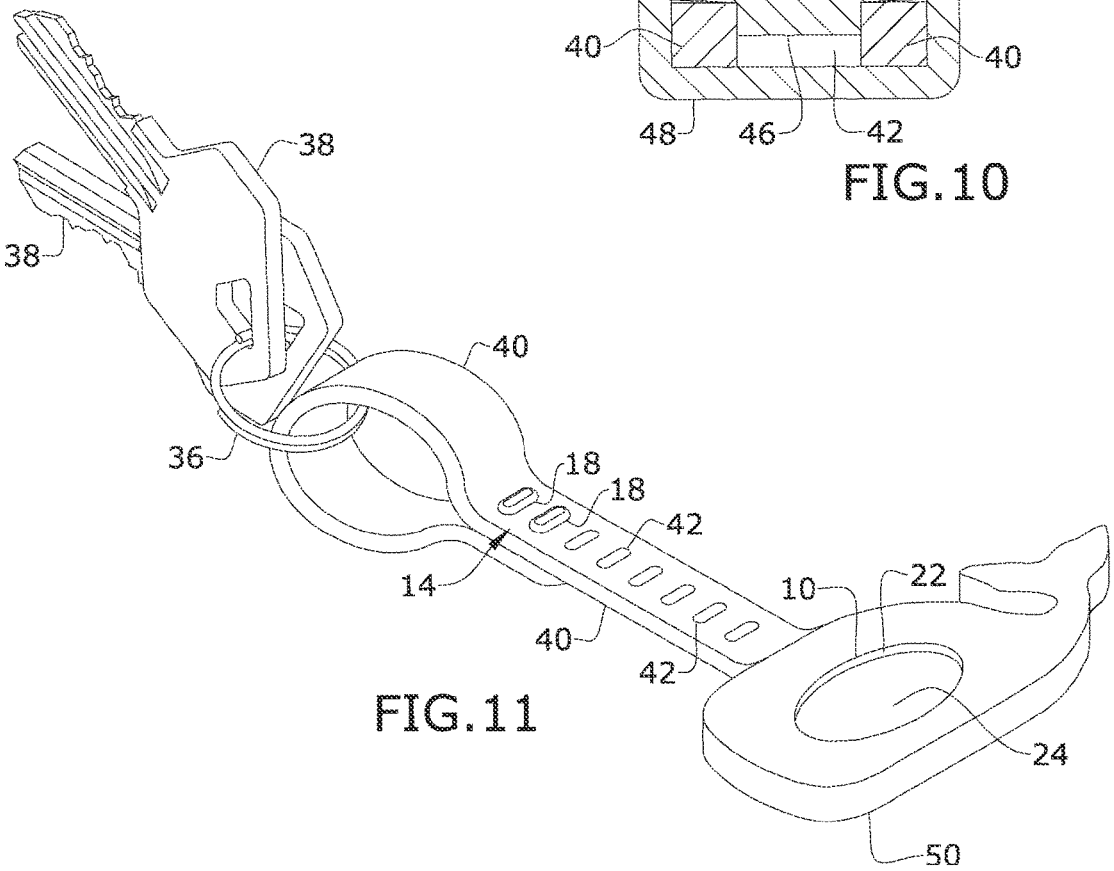
FIG. 11 is a perspective view of an exemplary embodiment of the present invention.

Referring to FIGS. 5 through 7, the souvenir holder 10 may be embodied in a charm/character shape 28 that is removable from the band portions 12 by way of a raised nodule 30. The raised nodule 30 may be removably connected to a nodule pocket 32 defined by spaced apart brackets 34 along the underside of the souvenir holder 10.

Referring to FIGS. 8 through 11, the souvenir holder 10 may be embodied in a charm/character shape 50 or be standard oval shaped but located a one end of only one band portion 40. Penetration points 42 may be adjacent the souvenir holder 10 and located at the opposing end of the only one band 40. As a result, the ends can be connected whereby the band 40 forms a loop. The loop could engage a key ring 36 of keys 38, or the like.

Furthermore, the present invention may have a stylized accessory 44 having a clasp opening nodule 46 defined by an accessory bracket 48, or prongs that fit into the penetration points 42.

A method of using the present invention may include the following. The souvenir holder 10 disclosed above may be provided. A user who would like to wear an elongated souvenir coin 24 may place their elongated souvenir coin 24 into the souvenir holder 10 by means necessary determined by the material—either by manipulation (stretching) or a locket style item. After placing the elongated souvenir coin 24 into the souvenir holder 10 the individual will secure the closure clasp by the penetration points 20 in the style selected. The individual would then wear it like any other watch, bracelet, or band.

It should be understood, of course, that the foregoing relates to exemplary embodiments of the invention and that modifications may be made without departing from the spirit and scope of the invention as set forth in the following claims.

What is claimed is:

1. A wearable souvenir holder, comprising:

a souvenir holder having an opening configured to secure a souvenir;

two band portions connected to the souvenir holder, wherein the two band portions are configured to form a loop;

a plurality of penetration points in each band portion; and a breakaway closure configured to move each band portion between a locked engagement and at least two unlocked engagements, wherein one of the two unlocked engagements includes a failing of the breakaway closure, wherein the breakaway closure has two prongs, each prong configured to slide through two penetration points of the plurality of penetration points that align during the formed loop, wherein each prong is elongated in a first direction, and wherein the first direction is orthogonal to a longitudinal direction of the two band portions, whereby a cross section of the two prongs is configured to ultimately fail against a force in said longitudinal direction, wherein said force is insufficient to break a wrist of a small child.

2. The wearable souvenir holder of claim 1, wherein said opening is defined by a deformable lipped edge.

3. The wearable souvenir holder of claim 2, wherein the souvenir holder is removably attached to the two band portions.

4. The wearable souvenir holder of claim 1, wherein the souvenir is an elongated souvenir coin.

5. The wearable souvenir holder of claim 1, wherein said opening is oval.

6. A wearable souvenir holder, comprising:

a souvenir holder having an opening configured to secure a souvenir;

two band portions connected to the souvenir holder;

a plurality of penetration points in each band portion;

a breakaway closure configured to move each band portion between a locked engagement and at least two unlocked engagements, wherein one of the two unlocked engagements includes a failing of the breakaway closure; and a nodule on the one or more band portions; and comprising a nodule bracket provided along an underside of the souvenir holder for removably connecting to said nodule.

7. The wearable souvenir holder of claim 6, wherein the souvenir is an elongated souvenir coin.

8. The wearable souvenir holder of claim 7, wherein said opening is oval.

9. A method of wearing an elongated souvenir coin, the method comprising:

providing the wearable souvenir holder of claim 8;

forming the loop around a body portion of a wearer by way of the two band portions; and moving each band portion to the locked engagement by way of the breakaway closure.

* * * * *